US005129772A

United States Patent [19]

Slautterback

[11] Patent Number: 5,129,772

[45] Date of Patent: Jul. 14, 1992

[54] ADHESIVE EXTRUSION METHOD FOR BOOKBINDING

[75] Inventor: Fred A. Slautterback, Carmel Valley, Calif.

[73] Assignee: Slautterback Corporation, Monterey, Calif.

[21] Appl. No.: 520,048

[22] Filed: May 7, 1990

[51] Int. Cl.[5] ..... B42C 9/00

[52] U.S. Cl. ..... 412/8; 412/4; 412/37; 281/40; 156/908

[58] Field of Search ..... 412/4, 6, 8, 13, 37; 156/908; 281/15.1, 21.1, 27, 40

[56] References Cited

U.S. PATENT DOCUMENTS

| | | | |
|---|---|---|---|
| 2,314,087 | 3/1943 | Heller | 281/21.1 X |
| 2,914,318 | 11/1959 | McGarvey et al. | 281/21.1 X |
| 3,531,358 | 9/1970 | Rost et al. | 156/475 |
| 3,707,418 | 12/1972 | Bhagat et al. | 156/245 |
| 4,201,615 | 5/1980 | French | 156/304 |
| 4,299,410 | 11/1981 | Jukola | 281/21 R |
| 4,484,850 | 11/1984 | Shimizu | 412/11 |
| 4,512,945 | 4/1985 | Vigano | 264/263 |
| 4,911,475 | 3/1990 | Lerman | 281/40 X |
| 4,925,354 | 5/1990 | Cote | 412/8 |
| 4,984,949 | 1/1991 | Reckziegel | 412/8 |

*Primary Examiner*—Joseph M. Gorski
*Assistant Examiner*—S. Thomas Hughes
*Attorney, Agent, or Firm*—Schneck & McHugh

[57] ABSTRACT

A method of manufacturing a soft-cover book of the type having an opening relaxed position in which front and read cover sections may lay flat against a support surface. A collection of pages are perfect bound to form a book block having a spine which is deformable along an arc of 180° without significantly affecting the bond strength of the book block. Preferably, the book block includes a thin flexible capping material across the spine and portions of the opposed sides of the book block. The book block is moved relative to a valved adhesive application station for selective extrusion of adhesive. The adhesive is extruded to form a plurality of adhesive application areas on the spine of the book block, with each application area being spaced apart from adjacent application areas by adhesive-free areas. A soft cover is then brought into contact with the adhesive application areas. Extrusion may be from an elongated outlet which intermittently applied adhesive across the width of the spine. Alternatively, extrusion may be from nozzles which are spaced apart to form spaced apart beads along the length of the spine.

7 Claims, 5 Drawing Sheets

ADHESIVE EXTRUSION METHOD FOR BOOKBINDING

TECHNICAL FIELD

The present application relates generally to bookbinding and particularly to a method of making a book whose pages lay flat when opened.

BACKGROUND ART

Historically, in the art of bookbinding a rotating applicator roller is employed to transfer adhesive to the spine of a book block. U.S. Pat. No. 4,484,850 to Shimizu teaches use of a container of hot-melt adhesive with an application roller extending partially into the container. As a book block passes the application roller, adhesive is applied to the spine of the book block, whereafter a cover is brought into contact with the adhesive to fix the cover to the book block.

U.S. Pat. No. 4,299,410 to Jukola teaches that application of adhesive to the spine of the book has the end result of forming a rigid spine so that the book opens poorly and is difficult to read. The Jukola patent teaches that even though the material of the cover may be flexible, the spine of the book is readily broken by attempts to press the book to an open position in which both the front and back cover sections lie flat against a support surface. The soft-cover paperback book of Jukola is formed by the method of adhering a flexible, firm support member to the spine of the book block and then applying stripes of adhesive on both the first and last page of the book block for fastening of the soft cover. Because the soft cover is not attached to the spine of the book block, the cover does not resist opening of the pages. Like the prior art described above, the adhesive strips on the first and last pages of the book block are typically applied by application rollers.

The above described method for making a softcover paperback book overcomes the problem of manufacture of books which lack flexibility so that they will not lay flat without damage to the book. However, the softcover extends beyond the edges of the book block upon opening of the book. This interferes with the ability of the book to lay flat against the support surface. Moreover, the projecting portion of the cover at the spine of the book creates stress points which make the cover subject to crushing or other damage.

It is an object of the present invention to provide a method, and a book manufactured by such method, for attaching a cover to a book block, with the cover exerting a minimal amount of interference to the flexibility of the book and a minimal amount of interference with the ability of the book to lay flat against a support surface.

SUMMARY OF THE INVENTION

The above object has been met by a binding method in which adhesive is extruded in a pressurized condition from one or more adhesive outlets onto the book block. In contrast to roller applicators of the prior art, adhesive is extruded via one or more apertures onto the block spine while maintaining the desired flexibility so that pages will lay flat.

The method of manufacture includes collecting a plurality of pages and binding the collected pages to form a book block having a spine which is deformable along an arc of 180 degrees without significantly affecting the bond strength of the book block. The book block may be a collection of individual pages or may be a group of signatures. The book block is moved relative to a valved adhesive application station for selective extrusion of pressurized adhesive. Extrusion may be from an elongated slot having a width at least as great as the width of the block spine. In this embodiment, the adhesive is selectively valved to provide intermittent applications so that the block spine includes a plurality of adhesive application areas spaced apart from adjacent application areas by adhesive-free areas.

As an alternative, the adhesive application station may include a plurality of spaced apart nozzle outlets. In this embodiment the adhesive is applied to the book block in the form of beads extending along the length of the block spine. Again, adhesive-free areas space apart areas which receive adhesive.

Preferably, the adhesive is also applied to the first and last pages of the book block. In the embodiment using an elongated extrusion slot, controlled "roll up" of adhesive provides application to the opposed sides. For the embodiment using outlet nozzles, additional outlet nozzles are directed for application to the opposed sides of the book block.

The volume of adhesive and the type of adhesive are key factors in determination of book rigidity. Adhesive is first applied to the spine to bind the pages together and applied a second time to fix the cover to the pages. The alternating adhesive-application areas and adhesive-free areas described above may be provided in either the first application, the second application, or both. If adhesive is applied to the entirety of the spine for fixing the cover to the pages, the cover adhesive should be of a type which allows flexing of the book cover, such as a pressure sensitive adhesive.

An advantage of the present invention is that the method permits a soft-cover paperback book to lie at rest with both the front and rear cover sections contacting a support surface and with a first portion of the pages resting against the front cover section and a second portion of the pages resting against the rear cover section. This flexibility is possible despite the application of adhesive to the block spine for securing the cover to the block spine. Securement of the cover to the block spine ensures that the backing section of a cover is not in a detached condition which would make the cover more vulnerable to damage.

A further advantage of the present invention is that adhesive application does not include an open pot of adhesive. Thus, the emission of fumes into the atmosphere is significantly reduced. More importantly, it is possible to use moisture curable hot-melt adhesive without exposure of a containment of adhesive to the atmosphere, where such exposure initiates setting of the adhesive.

BEST MODE FOR CARRYING OUT THE INVENTION

Figure 1:
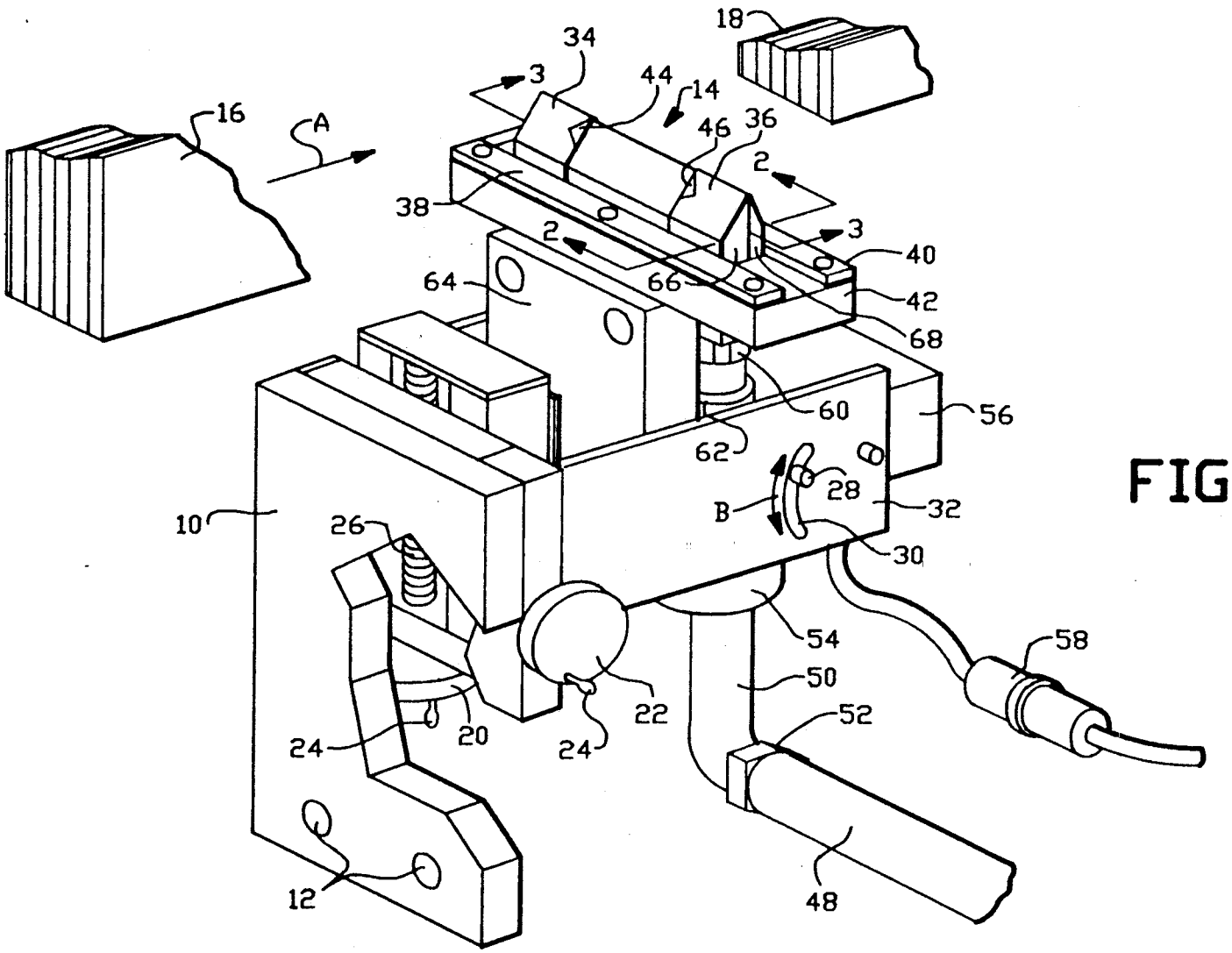
FIG. 1 is a perspective view of a first embodiment of an applicator head for bookbinding in accord with the present invention.
Figure 1A:
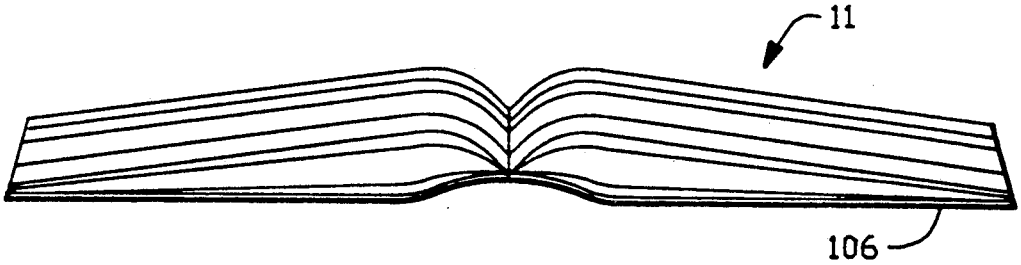
FIG. 1A is an end view of a bound book manufactured using the of FIG. 1.

With reference to FIG. 1, a first embodiment of an adhesive application apparatus for manufacture of the "lay flat" book 11 of FIG. 1A includes a mounting member 10 which is fastened to a support structure, not shown. Bores 12 within the mounting member permit fastening to the support structure by externally threaded bolts or the like. Mounting of the apparatus positions an applicator head 14 directly below the path of linearly moving book blocks 16 and 18. Arrow A indicates the direction of travel of the book blocks. "Book" and "book blocks" are each defined as a collection of pages to be bound together and are not limited to collated pages containing writing.

The relative positioning of the applicator head 14 to the linearly moving book blocks is important. A pair of control wheels 20 and 22 permit accurate registration. Rotation of the control wheels by means of handles 24 causes vertical and horizontal displacements of the applicator head. For example, rotation of the control wheel 20 turns a journal 26 to vertically move the applicator head relative to the fixed mounting member 10. In like manner, rotation of the control wheel 22 provides horizontal registration of the applicator head.

The angle of the applicator head 14 may be adjusted by movement of a projection member 28 within an arcuate slot 30 of a side bracket 32. The projection member 28 is moved within the arcuate slot, as shown by arrow B, until the applicator head is angled correctly. The applicator head is then fastened in position.

In addition to the vertical, horizontal and angular adjustments described above, the applicator head 14 includes a pair of spaced apart side guide clamp members 34 and 36 which are slidably attached to opposed ends of the applicator head. As the book block 16 progresses past the applicator head, the side guide clamp members exert compression forces on the opposite sides of the book block. The clamp member 34 and 36 may be selectively moved closer or farther apart to accommodate book blocks of varying sizes. The lower ends of the clamp members are sandwiched between lock brackets 38 and 40 and a metallic block 42. Adjustment of the clamp members 34 and 36 is accomplished by loosening of the fastening screws which hold the lock brackets to the metallic block so as to release the lower ends of the clamp members. The clamp members should contact the opposite sides of the book block, whereafter the lock brackets 38 can again be fastened to securely capture the clamp members. Machined into the clamp members are recesses 44 and 46. With respect to book travel, the recesses are at the rearward sides of the clamp members. These recesses aid in guiding the lead corners of each book block as the book block approaches the applicator head 14.

Pressurized hot-melt adhesive from a remote supply is brought to the applicator head 14 via hoses 48 and 50 connected by a fastening nut 52. The melted adhesive enters a solenoid valve 54. Actuation of the solenoid valve regulates fluid communication between the supply and the applicator head 14. Adhesive flow from the solenoid valve is through a heater member 56 having thermal units, not shown, to maintain the adhesive in a melted state. Electrical power and control signals for the thermal units and the solenoid valve are supplied via a conduit 58. The coupling assembly of the heater member 56 to the applicator head 14 includes a pair of swivel nuts 60 and 62 which provide an inelastic coupling and allow for dimensional tolerances of the interconnected parts.

A heat transfer block 64 provides a heat flow path that is separate of the adhesive flow path from the heater member 56 to the applicator head 14. The heat transfer block is made up of material having a high thermal conductivity, such as aluminum. Provision of a heat flow path that is separate from the adhesive flow path avoids the extra expense and complexity that would result from adding a second heating unit to the applicator head 14. Preferably, the heat transfer block either includes or is operatively coupled to a mechanism for oscillating the application head vertically to aid in driving adhesive into the interstices of the backbone of the book 16.

Figure 3:
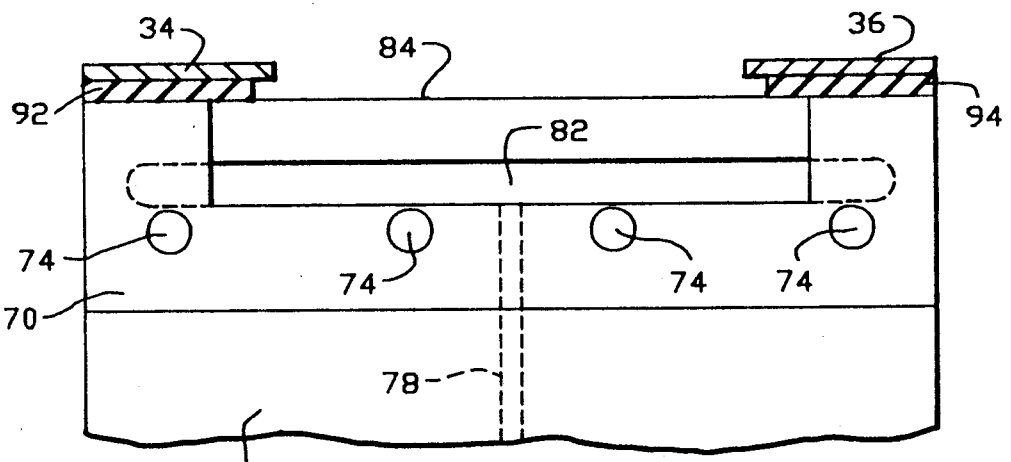
FIG. 3 is a rear sectional view of the applicator head of FIG. 1 along lines 3—3.
Figure 2:
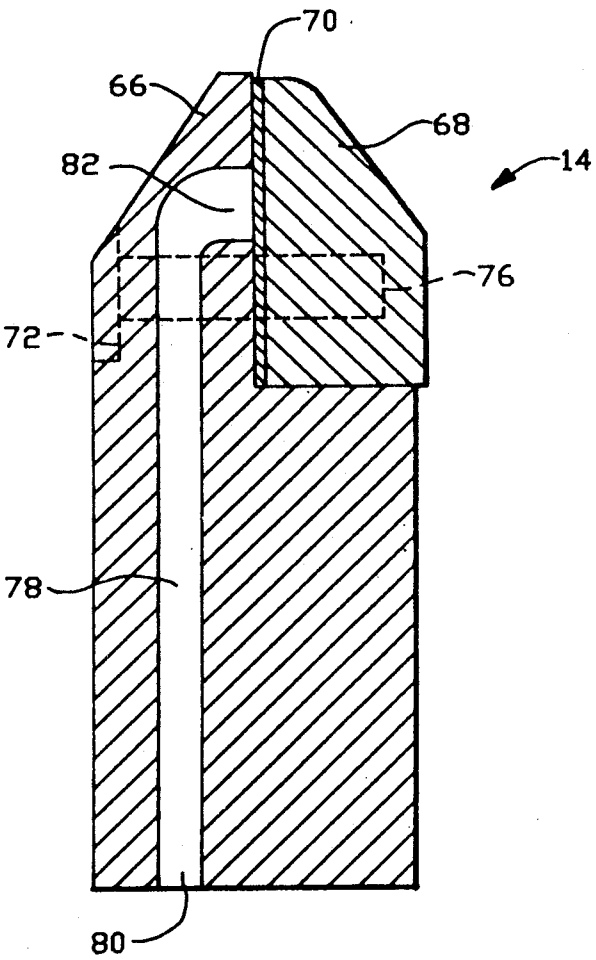
FIG. 2 is a side sectional view of the applicator head of FIG. 1, taken along lines 2—2.
Figure 5:
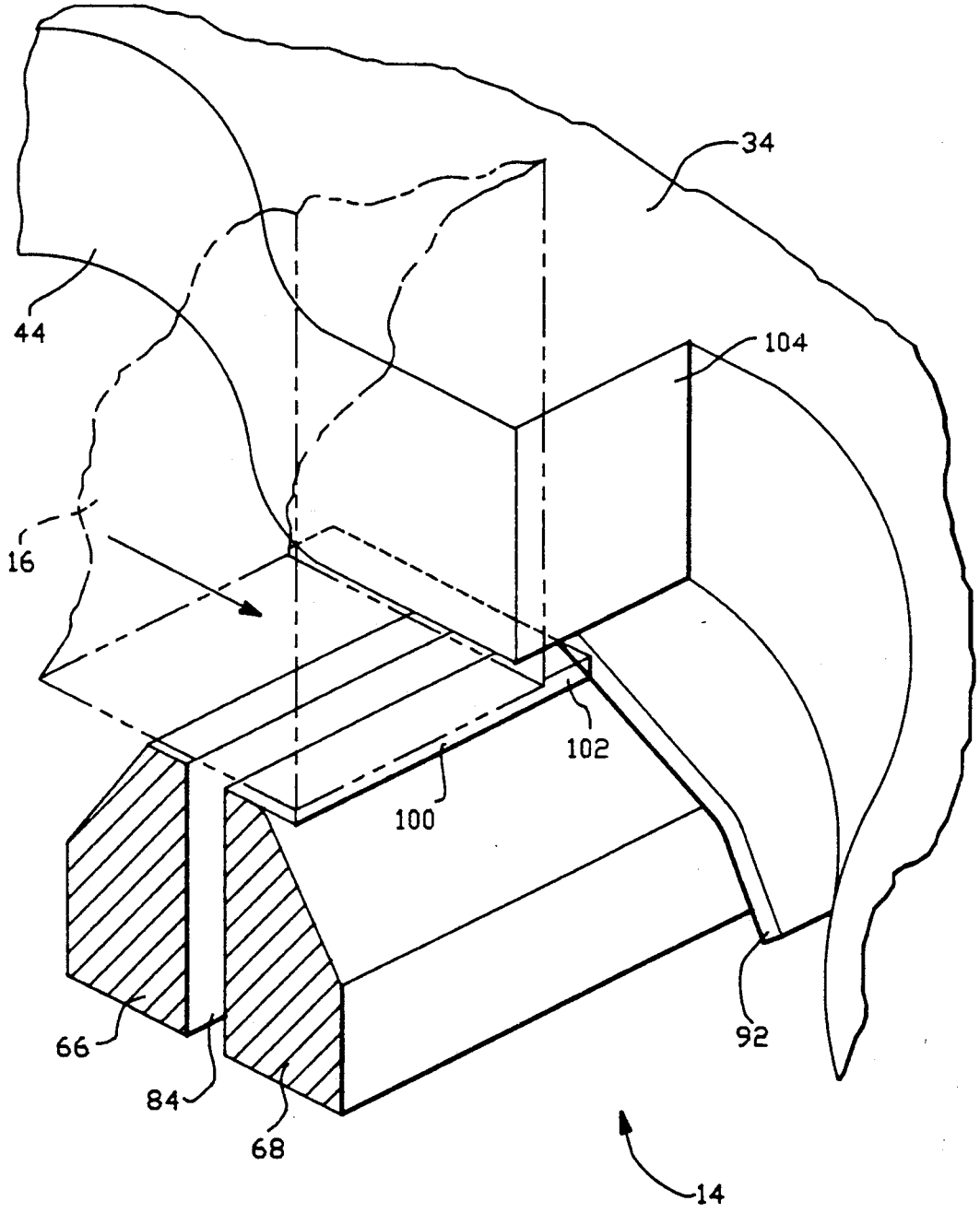
FIG. 5 is a perspective view of a book block traveling past the applicator head of FIG. 4.

Referring now to FIGS. 2 and 3, the applicator head 14 includes a slot body 66, a blade 68 and a shim 70 which is captured between the slot body and the blade. The three elements 66, 68 and 70 include corresponding bores 72, 74 and 76 to receive a fastening bolt, not shown, to secure the elements together. The slot body 76 has an upwardly extending adhesive passageway 78 having an inlet 80 in fluid communication with the solenoid described above for regulating flow of adhesive to the applicator head 14. At the end of the passageway 78 opposite to the inlet 80 is an elongated opening 82. The shim 70 is a C-shaped member which is open at an upper end. Because the shim spaces the blade 68 apart from the slot body 66, the open end of the shim defines a gap for extrusion of adhesive. Referring briefly to FIG. 5, the thickness of the C-shaped shim defines the width of an extrusion slot 84 between the slot body 66 and the blade 68.

Figure 4:
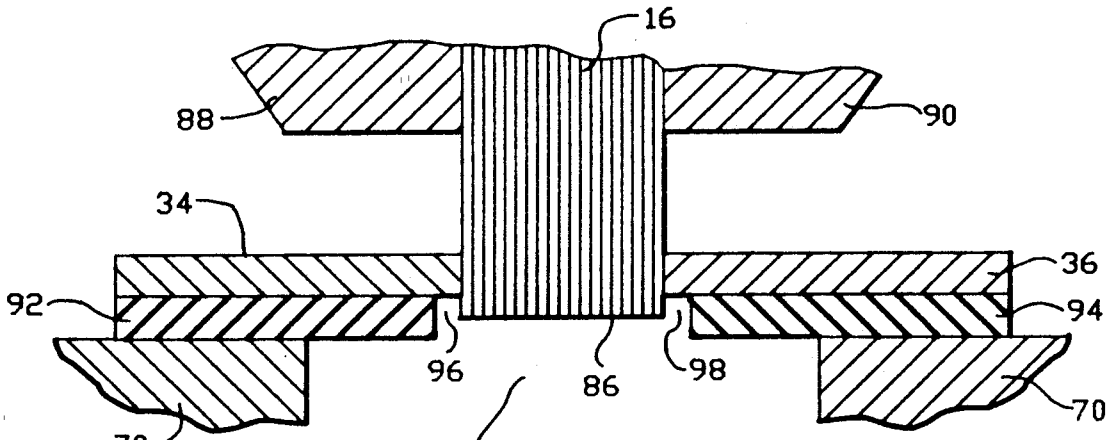
FIG. 4 is a rear sectional view of one edge of a book block secured in position relative to the applicator head of FIG. 3.

Referring now to FIGS. 2–4, the elongated opening 82 in the slot body 66 feeds adhesive to the extrusion slot 84 between the slot body and the blade 68. The adhesive is applied to the backbone 86, or spine, of the book 16. As noted above, the applicator head includes a pair of side guide clamp members 34 and 36 which apply compression forces to the opposed sides of the book 16 as the book progresses past the applicator head. A second pair of clamps 88 and 90 is shown in FIG. 4. Unlike the fixed side guide clamp members 34 and 36, the clamps 88 and 90 travel with the book 16 during the bookbinding process.

Captured between each side guide clamp member 34 and 36 and the applicator 14 is a slot seal 92 and 94. The slot seals are attached to the laterally slidable clamp members 34 and 36. The slot seals are preferably made of an elastomeric material and seal that portion of the extrusion slot 84 covered by the seal. The laterally slidable clamp members 34 and 36 are positioned to contact the sides of the book block 16. The slot seals 92 and 94, on the other hand, are spaced apart from the sides of the book to define recesses 96 and 98. The recesses 96 and 98 allow adhesive to reach the sides of the book nearest the backbone 86. This "roll up" aspect is important in the bookbinding industry.

In operation, the applicator head 14 of FIGS. 1-5 applies a film of adhesive to the spine of a book 16. The thickness of the film partially determines the flexibility of the spine. As noted above, the blade 68 is offset relative to the slot body 66. That is, the height of the blade 68 is lower than the height of the slot body. The offset of the blade determines the thickness of the adhesive layer 100 on the spine of the book 16, as thus seen in FIG. 5. In practice, the book block 16 is held above the level of the slot body 66 so that the thickness of the adhesive layer 100 on the spine of the book block is greater than the offset of the blade. Preferably, the offset of the blade is within the range of 0.001 inch and 0.01 inch and the thickness of the adhesive film is within the range of 0.005 inch and 0.015 inch. The adhesive is preferably moisture curable reactive polyurethane adhesive.

Referring to FIG. 4, adhesive is applied along the spine 86 of the book block 16, as well as to the opposed sides of the book block via recesses 96 and 98. The recesses permit a roll up application of adhesive along the opposed sides. The corner wrap increases the strength of the bond. The roll up application 102 is best seen in FIG. 5. The thickness of the slot seal 92 determines the height of the roll up application 102 onto the sides of the book block.

Also seen in FIG. 5, is a machined notch 104 in the side guide clamp member 34. The notch is approximately 0.125 inch from the center of the extrusion slot 84, but this is not critical. The function of the notch 104 is to reduce the likelihood of continued application of adhesive to the book block after cutoff of the applicator head 14. While the adhesive layer 100 is shown as beginning at the lead edge of the book block 16, in practice the lead and trail ends of the book block do not receive adhesive. After application of adhesive, the lead and trail ends of the book block are typically trimmed to produce a book of the desired size. The portions of the book block which have been trimmed are sold as waste. The value is significantly affected by the presence of adhesive. Here, the notch 104 prevents the side guide clamp member 34 from wiping adhesive onto the trail regions of the book block after adhesive cutoff, thereby increasing the value of the paper waste. An identical notch is machined into the other side guide clamp member.

A book cover 106 shown in FIG. 1A may then be applied directly to the book block. However, a thin, flexible capping material between the spine of the book block and the book cover 106 is preferred. This is particularly true for soft-cover paperback books, as described in U.S. Pat. No. 4,299,410. The capping material may be thin craft paper, netting, or a thin film of plastic. The external surface of the capping material has no adhesive properties and will not adhere to the interior surface of the cover.

Figure 6:
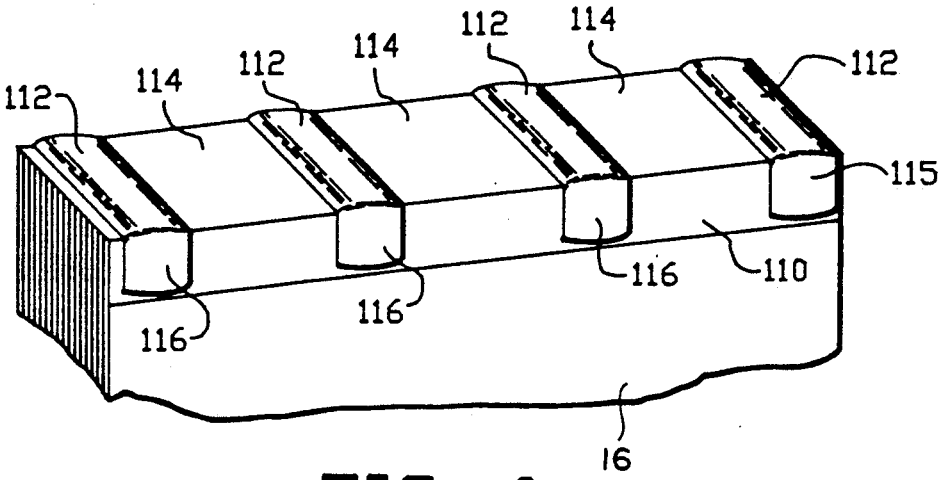
FIG. 6 is a perspective view of a book block having adhesive bands applied by the applicator head of FIG. 1.

A bookbinding process may require two of the adhesive application stations illustrated in FIGS. 1-5. The first station operates to bind the individual pages or the collection of signatures together, as well as to attach the thin, flexible capping material to the book block. The second station operates to apply adhesive for applying the cover 106 to the book block. This is illustrated in FIG. 6. Adhesive is applied to the book block 16, whereafter capping paper 110 is pressed into place. The book block continues down line to a second applicator head which is valved to intermittently apply adhesive in the form of transverse bands 112. The transverse bands are spaced apart from each by adhesive-free areas 114. The roll up feature of the applicator head allows corner wrap 116 of adhesive to the opposed sides of the book. The corner wrap ensures a more secure fit of the book cover to the book block.

After application of the transverse bands 112 onto the capping paper 110, a book cover having a flexible backing section is pressed into place against the spine of the book block. The resulting book has a spine which easily flexes without effect to the bond strength. Typically, adhesive is the primary factor in book rigidity. For this reason, hard cover books which have the desired characteristic of laying flat against a support surface, such as a desk, are sewn. This sewing process, however, significantly adds to the expense of the bookbinding. By using the applicator head described above, adhesive application for attachment of the book cover can be reduced to the plurality of transverse bands 112. The adhesive-free areas 114 allow the flexible backing section of the book cover to slide freely within these areas to accommodate the forces involved in arcing of the book spine during opening of the book.

It has been discovered that additional flexibility is possible by use of a moisture curable reactive polyurethane adhesive. This type of adhesive provides a greater bond strength per volume of adhesive than is experienced with use of other adhesives. It is possible to apply transverse bands, much like bands 112, directly to the bare pages of the book block. That is, adhesive application across the entire spine is not necessary in use of polyurethane adhesive. The adhesive is applied with such pressure that it penetrates into the interstices of the spine. A second application of adhesive is used to fix the soft cover to the book block. It is possible to use the intermittent application method to bind the pages and to then use a full-coverage application to adhere the cover to the pages. In this embodiment, however, the cover bond adhesive should be a flexible adhesive which does not penetrate into the interstices of the book block since such penetration would interfere with the flexibility of the book. A pressure sensitive adhesive is preferred.

Figure 7:
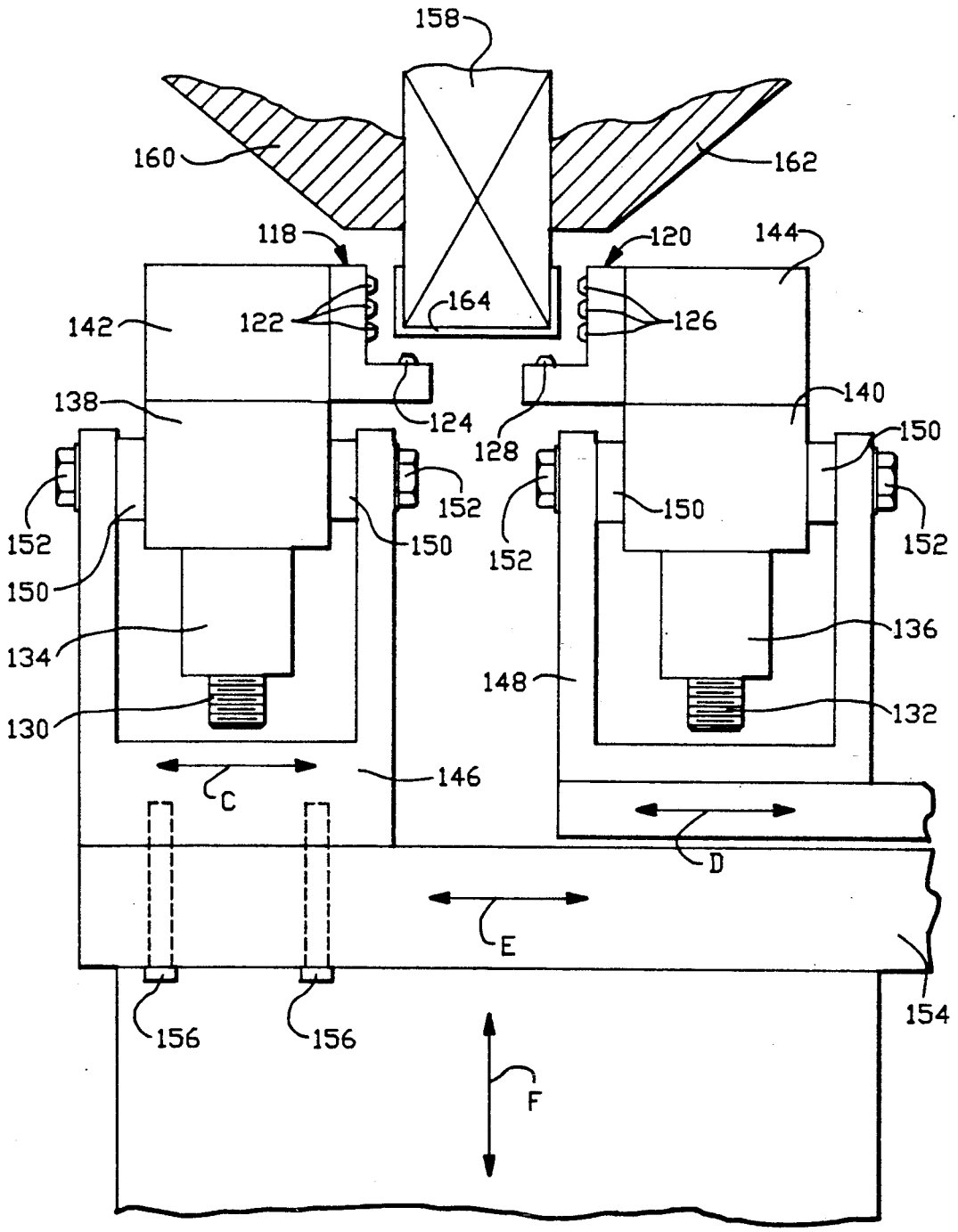
FIG. 7 is a rear view of a second embodiment of an applicator head for bookbinding in accord with the present invention.

FIG. 7 illustrates a second embodiment of an adhesive application station for carrying out the present invention. Rather than extruding adhesive through an elongated slot, the station of FIG. 7 includes a pair of nozzle manifolds 118 and 120, each having a plurality of nozzle outlets. The first nozzle manifold 118 includes three horizontally-directed nozzle outlets 122 in a single vertically-directed nozzle outlet 124. The second nozzle manifold has the same orientation of horizontal and vertical nozzle outlets 126 and 128. Adhesive from a remote supply, not shown, is channeled to adhesive inlets 130 and 132 of solenoids 134 and 136. Activation and deactivation of the solenoids regulate flow through a heater member 138 and 140. Between each heater member and the associated nozzle manifold is a metallic block 142 and 144 having a high thermal conductivity and having a passageway therethrough for channeling adhesive from the heater member to the nozzle manifold.

Each heater member 138 and 140 is attached to a head mounting bracket 146 and 148 by means of bolts 150 and thermal insulation spacers 152. The head mounting brackets 146 and 148 are attached to a support table 154. As shown in FIG. 7, the first head mounting bracket 146 is coupled to the support table by a pair of bolts 156. The lower surface of the head mounting bracket 146 includes a slot which receives the bolts 156. The bolts can be loosened to allow adjustment of the relative position between the first nozzle manifold 118 and a book block 158. That is, the first head mounting bracket 146 is laterally adjustable, as indicated by arrow C.

The second head mounting bracket 148 is likewise slotted and is coupled to the support table 154 by bolts, not shown. Thus, the second nozzle manifold 120 may be selectively moved relative to the book block 158 for proper positioning of the nozzle outlets 126 and 128. Adjustment of the second head mounting bracket 148 is indicated by arrow D. It is possible to simultaneously move the pair of head mounting brackets 146 and 148 relative to the book block 158 by lateral adjustment of the entire support table, as indicated by arrow E. Vertical adjustment is also possible, as indicated by arrow F.

The book block 158 is secured by a pair of book clamps 160 and 162 which travel past the nozzle manifolds 118 and 120. Preferably, the applicator head 14 of FIG. 1 is used to bind the book block 158, which is either a collection of individual leaves or a number of signatures. The applicator head 14 extrudes adhesive in a manner to also bind the thin, flexible capping material 164 to the spine and opposed sides of the book block pages. Downline of the applicator head 14 is the station illustrated in FIG. 7. Alternatively, binding of the pages of the book block may be performed by a modified multi-line nozzle manifold, with the multi-line nozzle manifolds of FIG. 7 then being used for attachment of the book cover.

Figure 8:
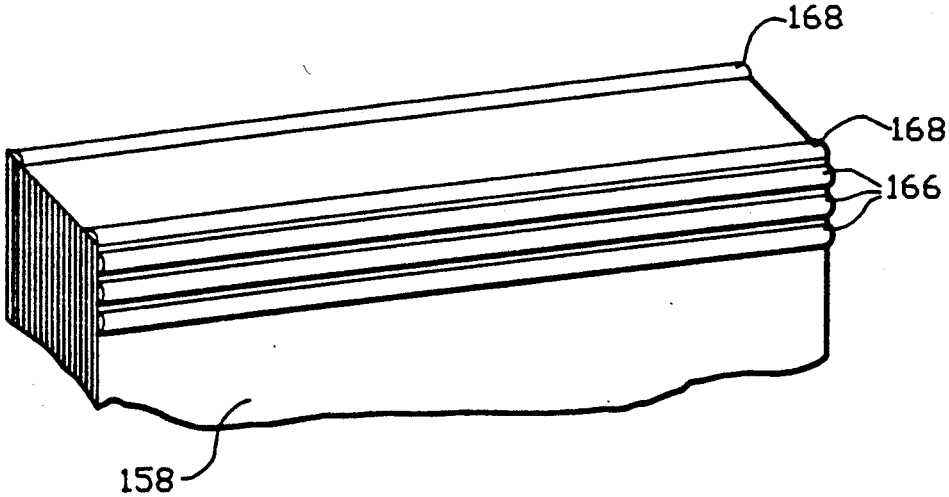
FIG. 8 is a perspective view of a book block having received adhesive beads applied by the applicator head of FIG. 7.

The horizontally-directed nozzle outlets 122 and 126 of the opposed nozzle manifolds 118 and 120 extrude pressurized adhesive onto the sides of the book block. The nozzle outlets are positioned for accurate adhesive placement of narrow half-radius, hemispheric adhesive beads 166 without contact with the book block 158, as shown in FIG. 8. A center-to-center spacing in the range of 0.07 inch to 0.095 inch is preferred. The vertically-directed nozzle outlets 124 and 128 apply thin beads 168 of adhesive along the spine of the book block. While the nozzle outlets 124 and 128 of the manifolds 118 and 120 are shown as being capable of only applying a pair of beads along the spine of the book block, optionally the nozzle manifolds may each have two or more vertically-directed nozzles. However, the beads of adhesive should not be so closely spaced that contact of the book cover with the book block would compress the adhesive to cover the entirety of the spine.

After application of adhesive to the spine and opposed sides of the book block 158, a cover is pressed against the adhesive. The resulting book is one having the ability to lay flat on a support surface. Upon opening the book, the backing section of the cover is able to slide along the adhesive-free areas of the spine so as not to inhibit this ability to lay flat. In an open, rest position, the book has front and rear cover sections contacting the support surface, with the first portion of pages resting against the front cover section and a second portion of pages resting against the rear cover section, as shown in FIG. 1A.

As an alternative to the nozzle manifold 118 and 120 of FIG. 7, it is possible to exclude the horizontally-directed nozzles 122 and 126. The adhesive extruded from the horizontally directed nozzles are preferred since side-apply adhesive adds to the strength of the book. The increased strength, however, is not critical. Other arrangements of nozzles are also possible. What is important is that the adhesive be applied by pressurizing adhesive from adhesive outlets such as the elongated outlet of FIG. 1 and the nozzle outlets of FIG. 7. Also important is that adhesive-free areas are provided between adhesive application areas, but as noted above it is not critical that the adhesive-free areas exist in both the first application for binding pages and the second application for fixing the cover to the pages.

I claim:

1. A method of making a book of the type having pages and a front cover section which swing freely over an arc of 180 degrees relative to a rear cover section, said method comprising the steps of:

assembling a plurality of pages thereby forming a book block having a flexible spine at first edges of said pages, said flexible spine having a predetermined length and width, securing said first edges in a generally parallel relationship by extruding pressurized first adhesive from an elongated adhesive outlet onto first and second areas of said flexible spine such that said first and second areas are spaced apart by an adhesive-free area, providing setting of said first adhesive such that said first and second areas remain spaced apart by said adhesive-free area, and adhering a cover having front, rear and flexible backing cover sections to said book block by applying a second adhesive across substantially the entire width of said flexible spine and bringing said flexible backing cover section into contact with said second adhesive across the entire width of said spine, thereby preventing nonparallel alignment of said first edges upon opening of said book block, whereby said steps form a book having a relaxed open position in which said front and rear cover sections may rest along a substantially common plane, with a first portion of said pages resting on said front cover section and the second portion of said pages resting on said rear cover section and with said first edges of pages of both said first and second portions remaining parallel.

2. The method of claim 1 wherein said extruding pressurized first adhesive is performed by intermittently extruding adhesive through an elongated adhesive outlet having a lengthwise direction substantially perpendicular to the length of said flexible spine of said book block, said first and second areas each extending across the width of said flexible spine.

3. The method of claim 2 wherein said step of extruding first adhesive includes forming a third area of adhesive application parallel to said first and second areas and spaced apart from said second area by a second adhesive-free area.

4. The method of claim 2 further comprising extruding first adhesive from said elongated adhesive outlet along said flexible spine and onto opposed sides of said book block.

5. The method of claim 1 further comprising adhering said front and rear cover sections to opposed sides of said book block.

6. The method of claim 1 wherein said adhering of said cover is an adhering of a paperback cover.

7. The method of claim 1 wherein said first adhesive is a moisture curable reactive polyurethane adhesive.

* * * * *